US009364961B2

(12) United States Patent
Lelieveld

(10) Patent No.: US 9,364,961 B2
(45) Date of Patent: Jun. 14, 2016

(54) SHAVING DEVICE HAVING A SAFE RAZOR BLADE UNIT

(75) Inventor: Mark Johannes Lelieveld, Drachten (BL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 701 days.

(21) Appl. No.: 13/496,122

(22) PCT Filed: Sep. 30, 2010

(86) PCT No.: PCT/IB2010/054423

§ 371 (c)(1), (2), (4) Date: Mar. 14, 2012

(87) PCT Pub. No.: WO2011/042842

PCT Pub. Date: Apr. 14, 2011

(65) Prior Publication Data

US 2012/0174409 A1 Jul. 12, 2012

(30) Foreign Application Priority Data

Oct. 5, 2009 (EP) ..... 09172165

(51) Int. Cl.
*B26B 21/22* (2006.01)
*B26B 21/40* (2006.01)

(52) U.S. Cl.
CPC ..... *B26B 21/227* (2013.01); *B26B 21/4018* (2013.01); *B26B 21/4031* (2013.01)

(58) Field of Classification Search
CPC ..... B26B 21/22; B26B 21/40187; B26B 21/4031
USPC ..... 30/34.2, 79
See application file for complete search history.

(56) References Cited

U.S. PATENT DOCUMENTS

| | | | | |
|---|---|---|---|---|
| 3,500,539 | A * | 3/1970 | Muros | 30/40.1 |
| 4,063,354 | A | 12/1977 | Oldroyd et al. | |
| 4,443,940 | A | 4/1984 | Francis | |
| 4,461,079 | A | 7/1984 | Ciaffone et al. | |
| 5,070,612 | A | 12/1991 | Abatemarco | |
| 5,084,969 | A | 2/1992 | Althanus | |
| 5,224,267 | A | 7/1993 | Simms et al. | |
| 5,551,153 | A | 9/1996 | Simms | |
| 5,557,851 | A | 9/1996 | Ortiz | |
| 6,266,884 | B1 | 7/2001 | Prochaska | |
| 6,295,734 | B1 * | 10/2001 | Gilder et al. | 30/50 |
| 7,797,834 | B2 | 9/2010 | Steunenberg | |
| 2007/0151108 | A1 * | 7/2007 | Westerhof et al. | 30/50 |
| 2012/0174409 | A1 * | 7/2012 | Lelieveld | 30/34.2 |

FOREIGN PATENT DOCUMENTS

| | | | |
|---|---|---|---|
| CN | 1149851 | A | 5/1997 |
| JP | 5627290 | A | 3/1981 |
| WO | 9504637 | A1 | 2/1995 |
| WO | WO 96/25276 | * | 8/1996 |
| WO | 2005072919 | A1 | 8/2005 |
| WO | WO 2010/068076 | A2 * | 6/2010 |

* cited by examiner

*Primary Examiner* — Hwei C Payer

(57) ABSTRACT

Razor blade unit for shaving a skin comprising a stretcher, a rear support and at least one blade (11) allocated in between the stretcher (9) and the rear support (10). The blade (11) is movable with respect to an exposure plane (14) from a rest position to a working position. The exposure plane (14) is defined as a tangential plane from the stretch surface to the support surface. An adjusting mechanism (15) is provided to adjust the movable blade from the rest position to the working position during a sliding movement of the razor blade unit over the skin in the shaving direction.

13 Claims, 4 Drawing Sheets

SHAVING DEVICE HAVING A SAFE RAZOR BLADE UNIT

FIELD OF THE INVENTION

The invention relates to a safe razor blade unit.

BACKGROUND OF THE INVENTION

U.S. Pat. No. 6,295,734 discloses a razor blade unit which has a guard, a cap and three parallel blades mounted between the guard and the cap. At least one of blades, guard and cap can be moved from a non-shaving rest position to modify a blade exposure dimension in order to attain a target blade geometry at which shaving is initiated. As regards the target blade geometry, the exposure of the first blade is not greater than zero and the exposure of the third blade is not less than zero. At least one of the cap and the guard can be movable against the force of a spring from a rest position in which all the blades between the guard and the cap have their cutting edges disposed below a plane tangential to the skin contacting surfaces of the guard and cap. The blades can be independently sprung or carried for movement in unison on a carrier pivotally mounted in a frame of the blade unit.

One drawback of the razor blade unit is that in the initial phase of the shaving process, the risk of undesired cutting of the skin is too high. The razor blade unit is normally mounted on a longitudinal handle. A user may hold the handle in his hand and put the razor blade unit to his skin. When contacting the skin, the blades of the razor blade unit move towards the skin, which too many times leads to cutting of the skin. This may result in fast-bleeding wounds. Additionally, in practice, it has been established that it is rather impossible for a user to contact the skin without even slightly vibrating the handle of the razor. The vibrating movements of the handle increase the risk of accidental cutting of the skin.

OBJECT OF THE INVENTION

It is an object of the present invention to at least partially eliminate the above mentioned drawbacks and/or to provide a useable alternative. In particular, it is an object of the invention to provide a safer razor blade unit.

SUMMARY OF THE INVENTION

According to the invention, this object is achieved by a razor blade unit comprising a stretcher having an outer stretch surface for stretching the skin in a shaving direction, a rear support having an outer support surface which in use contacts the skin to support the razor blade unit, at least one blade located between the stretcher and the rear support, wherein the blade has a relative position with respect to an exposure plane, said exposure plane being an imaginary plane tangent to an outer stretch surface and to the outer support surface, wherein said relative position is adjustable from a rest position to a working position by means of an adjusting mechanism, wherein in the rest position the skin is less exposed to the blade than in a working position wherein the adjusting mechanism is actuatable by a drag force exerted by the skin on the stretcher during a sliding movement of the razor blade unit over the skin in a shaving direction of the razor blade unit.

The razor blade unit for shaving a skin according to the invention comprises a stretcher having an outer stretch surface for stretching a skin in a shaving direction. The stretcher may be made from an elastomeric material and may have flexible lips to obtain grip on a skin surface. The lips may bend during a shaving movement to stretch the skin. The skin causes a drag force on the stretcher.

The razor blade unit further has a rear support. The rear support has an outer support surface which in use contacts a skin to support the razor blade unit. The rear support may comprise an agent e.g. a lubrication or cleaning agent for an aftertreatment of the skin when the razor blade unit passes the skin. At least one blade is located between the stretcher and the rear support. The blade may be connected to a blade housing. Several blades may be arranged in an array in the blade housing.

According to the invention, the blade has a relative position with respect to an exposure plane which is defined as an imaginary plane tangent to the outer stretch surface and to the outer support surface. Said relative position is adjustable from a rest position to a working position by means of an adjusting mechanism, wherein in the rest position the skin is less exposed to the blade than in the working position. The adjusting mechanism is actuable under the influence of a drag force exerted by the skin on the stretcher during a sliding movement of the razor blade unit over the skin in a shaving direction of the razor blade unit.

Preferably, during use the exposure plane may be mated with a skin surface. The blade has a blade edge which, in the rest position, is positioned at a distance from the exposure plane, i.e. above skin level, while in the working position the blade edge has been moved in a direction towards the exposure plane for shaving. In the working position, the blade edge has come closer to the exposure plane. The blade edge may move upwards, away from the skin, and downwards toward the skin. The movement of the blade may be a translational or a rotational movement.

The adjusting mechanism is provided to move the movable blade from the rest position to the working position. During a sliding movement of the razor blade unit over the skin, a drag force occurs in the shaving direction as a result of the skin being stretched. The drag force enables the movement of the blade towards the working position. The drag force acts on the stretcher, which may be movably connected to the remaining components, a framework, of the razor blade unit to enable a relative movement caused by the drag force. Alternatively, the stretcher may be compressible as a result of the drag force.

During shaving, the working position is available during a sliding movement of the razor blade unit over the skin. The risk of undesired cutting during other shaving actions, in particular during a first contact with the skin, may be reduced when the razor blade unit is handled with the blade in the safe rest position. As a result of the sliding movement, the skin is stretched before the blade is adjusted to the working position. Advantageously, instead of a ploughed skin, the stretched skin is less vulnerable to irritation or cutting when the blade moves to the exposure plane and thus approaches the skin. As a result, the razor blade unit according to the invention may be safer in use.

In an embodiment of the razor blade unit according to the invention, the adjusting mechanism may comprise an actuator and a sensor. The actuator is configured to move the blade with respect to the exposure plane. The sensor is configured to detect a drag force. The sensor may be a force-measuring sensor which is able to measure a drag force. The sensor may be a displacement sensor for measuring a displacement of e.g. the stretcher. In particular, the sensor is connected to the stretcher. The sensor may be electrically connected to the actuator. When a drag force is detected, the actuator may be activated to bring the blade from the rest position into the working position. When the drag force reduces to zero, the sensor may generate a signal to the actuator to return the blade to the rest position.

Alternatively, the actuator may be programmed to return the blade to the rest position in the case of a lack of a sensor signal. Advantageously, the actuator-sensor adjusting mechanism may provide a simple and compact configuration of the razor blade unit. The actuator-sensor assembly may provide design freedom in that the movement of the blade may be programmed so as to obtain the desired shaving conditions.

In an embodiment of the razor blade unit according to the invention, the adjusting mechanism comprises a transmission for transferring a relative, in particular linear, movement of the stretcher or rear support in the exposure plane into a substantially perpendicular movement of the blade towards the exposure plane. The relative movement of the stretcher or rear support may be caused by a drag force. A biasing element may be provided for returning the blade back into the rest position. Advantageously, there is no need for batteries or the like, which may provide a safe and sustainable razor blade unit.

In an embodiment of the razor blade unit according to the invention, the adjusting mechanism comprises linked bars serving as a transmission element. The linked bar mechanism may provide a transmission from a movement in the exposure plane to a movement perpendicular to the exposure plane. The linked bar mechanism may e.g. be a knee mechanism having two pivotally coupled bars. One bar, a long leg, may be connected to a relatively movable stretcher or rear support in the exposure plane, and the other bar, a short leg, may be connected to the blade, allowing a perpendicular movement. By virtue thereof, a movement in the exposure plane may easily and reliably be transferred to a perpendicular movement of the blade.

In an embodiment of the razor blade unit according to the invention, a blocking mechanism may be provided to prevent premature movement of the blade to the working position. The blocking mechanism may include a biasing element. The biasing element may be provided to return the blade into the rest position. After a shaving movement, and a corresponding adjustment of the razor blade unit from the skin, the biasing element forces the blade to move with respect to the exposure plane.

In an embodiment of the razor blade unit according to the invention, the biasing element may cooperate with a blocking element for blocking the blade in a first instance in the rest position. The biasing member exerts a preload. A movement of the blade is desired when the razor blade unit has been positioned on the skin, but only after the start of a shaving movement. During the initial start of the shaving movement the stretcher stretches the skin. During the sliding movement of the razor blade unit, the blocking element unblocks, which allows the blade to move with respect to the exposure plane to the working position. The drag force exerted by the skin is used to counteract and overcome the preload of the biasing element. The blocking mechanism may unblock an upward movement of the stretcher and/or the rear support and/or a downward movement of the blade.

In this manner, the blade may be brought into the working position after the skin has been stretched. The skin is transformed by the stretcher from a relatively ploughed appearance to a stretched, smoother appearance. The blade gets into the working position when the skin is stretched, which makes the skin less susceptible to being cut by the blade. A ploughed skin is more susceptible to being cut. Therefore, advantageously, the razor blade unit is safe in use and decreases the risk of bleeding cuts.

In an embodiment of the razor blade unit according to the invention, the stretcher may be movable, in a first movement, relative to the blade in the shaving direction and, in a second movement, upwards with respect to the blade. The second movement of the stretcher is in a direction substantially perpendicular to the exposure plane. When the stretcher moves upwards, it moves away from the skin. The exposure plane, which is defined by the stretcher surface, will move by moving the stretcher with respect to the blade and the support in the upward direction, resulting in a relative movement of the blade with respect to the exposure plane. During the first movement, the upward movement is blocked by the blocking element and the skin under the stretcher surface is being stretched. After sufficiently stretching the skin and increasing the drag force, the upward movement of the stretcher may be released by the blocking means, which results in a lowering of the blade. During the second movement, the stretcher may be movable in an upward direction with respect to the blade. As a result, the blade is lowered to the exposure plane and the blade edge is brought into the working position at skin level. In this manner, a simple and reliable configuration of the razor blade unit according to the invention may be advantageously achieved.

In an embodiment according to the invention, the stretcher may be in sliding contact with the blocking element. The blocking element may be positioned on top of the stretcher. The stretcher and the blocking element may be stacked together. The blocking element may have a recess at a lower surface, and the stretcher may have a complementary mating protrusion at an upper surface. The blocking element may cooperate with a biasing element to form a blocking mechanism. The biasing element of the blocking mechanism may be aligned with the stretcher. The biasing force may cause the stretcher to move in a shaving direction away from the rear support.

The biasing element may be resilient in the shaving direction. The biasing element may be a coil spring or a solid body made of a resilient compressible material. The biasing element and the stretcher may be constructed in one piece. The biasing means may be arranged as a compression element for generating a compression force as a preload. The compression element may compress the stretcher in the shaving direction. During the shaving process a drag force is caused which counteracts the compression force. As a result, the stretcher may move in the direction of the rear support, which may cause the protrusion of the stretcher to mate with the complementary recess of the blocking element. When the protrusion enters the recess, the blocking element no longer blocks the upward movement of the stretcher. The stretcher may be lifted, which results in a movement of the blade from the rest position to the working position.

In an embodiment of the razor blade unit according to the invention, the distance of a movement of the blades from the rest position to the working position is adjustable. The total movement to the exposure plane may be adjustable by delimiting an upward movement of one of the stretcher and the support face or by delimiting a downward movement of the blade. The position of at least one of the stretcher and the rear support may be adjustable in a direction perpendicular to the exposure plane. By virtue thereof, the working position may be adjustable with respect to the exposure plane. Advantageously, a user may adjust the working position to adapt the razor blade unit to characteristic properties of the individual skin. An individual person may be more susceptible to skin irritation and may for that reason desire a larger distance between the blade edge and the exposure plane. Another person might desire a smoother shaving result, which requires a closer working position with respect to the exposure plane. Advantageously, according to the invention the adjustable working position of the blade may satisfy those needs.

In an embodiment of the razor blade unit according to the invention, the blade has a blade edge which, in the working position, is located at a perpendicular distance of at most 150 μm, in particular at most 120 μm, more in particular at most 100 μm, from the exposure plane.

In an embodiment of the razor blade unit according to the invention, the exposure plane may be displaced by a movement of the rear support. During use, the rear support abuts against the skin. In a first movement the rear support may be movable in the shaving direction. During a shaving movement, a drag force may cause the rear support to move against a preload in a direction away from the blade. The first movement may subsequently be followed by a second movement in a direction substantially perpendicular to the exposure plane. The second movement may in first instance be blocked by a blocking mechanism. During the shaving movement, the blocking mechanism may release the second movement, which allows the blade to move to the working position.

In an embodiment of the razor blade unit according to the invention, the exposure plane may be displaced by a movement of both the rear support and the stretcher. Instead of moving just one of the stretcher and the rear support, which would lead to a slight inclination of the exposure plane, a movement of both surfaces may reduce this inclination and keep the angle of the blade edge with respect to the exposure plane substantially constant. Advantageously, in this manner a shaving angle in between the blade edge and the exposure plane may be kept substantially constant.

Further preferred embodiments are defined in the subclaims. Further, the invention relates to a shaving device including a razor blade unit according to the invention.

BRIEF DESCRIPTION OF THE DRAWINGS

The invention will be explained in more detail with reference to the appended drawings. The drawings show a practical embodiment according to the invention, which should not be interpreted as limiting the scope of the invention. Specific features may also be considered apart from the shown embodiment and may be taken into account in a broader context as characterizing features, not only for the shown embodiment but as a common feature for all embodiments falling within the scope of the appended claims, in which:

DETAILED DESCRIPTION OF EXAMPLES

Commonly used reference numbers in different Figures, indicate same or similar components.

Figure 1:
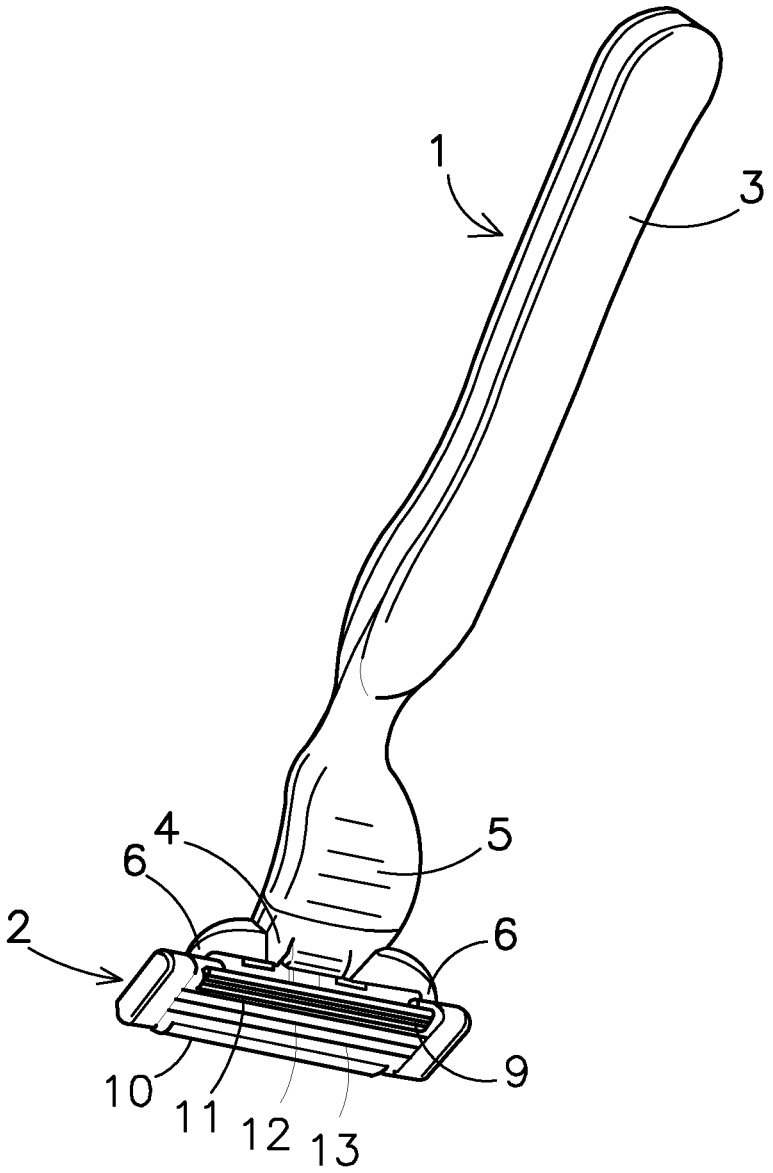
FIG. 1 shows a perspective view of a razor device according to the invention.

As shown in FIG. 1, an embodiment of a safety razor apparatus in accordance with the invention is provided with a grip portion 1 and a razor blade unit 2. The grip portion 1 comprises a part 3 that can be grasped by a shaving person, and a part 4 provided with a hinging or pivoting connection with the razor blade unit 2. Between part 3 and part 4, the grip portion 1 comprises a broadened part 5 having a larger width than said part 3.

Part 4 of the grip portion 1 is provided with two arms 6. Between the ends of the arms 6 there is a pin (not shown in the Figure), which pin is engaged by the razor blade unit 2. The pin forms the pivot axis for the razor blade unit 2.

The razor blade unit 2 is provided with a first guiding member, being a skin stretcher 9 in the embodiment shown, and with a second guiding member, in the embodiment shown, a rear support 10, being a lubrication member. Between the stretcher 9 and the rear support 10 there are three blades 11,12,13 having three parallel cutting blade edges. The three blades 11-13 are mounted in a fixed position in the razor blade unit 2 and the blade edges, during shaving, are positioned substantially in an exposure plane 14 (shown in FIG. 2) through the surface of the stretcher, the stretch surface and the support surface or the rear support. During the shaving operation the skin is substantially located in that exposure plane in the working position.

Figure 2A:
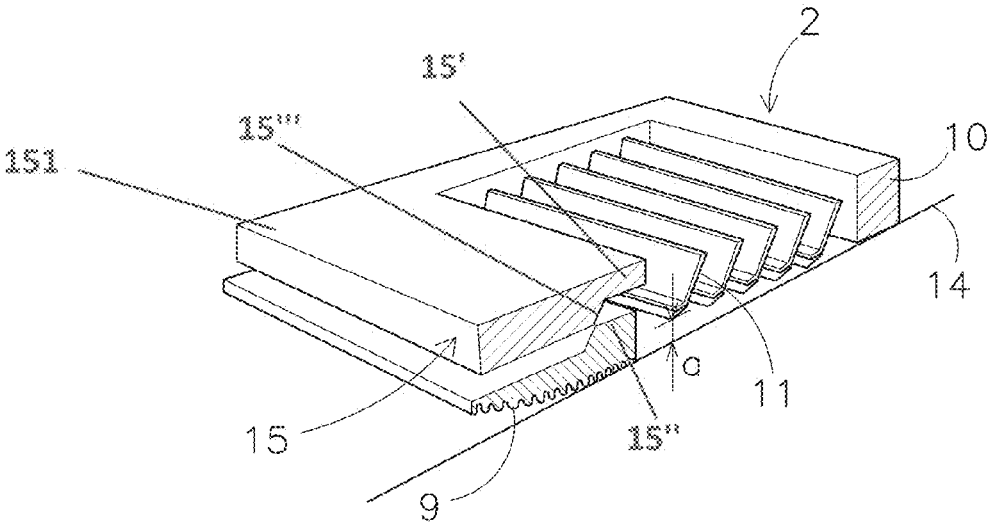
FIG. 2A shows a schematic cross sectional view of a razor blade unit including a blocking mechanism as an adjusting mechanism according to the invention having blades in a rest position.
Figure 2B:
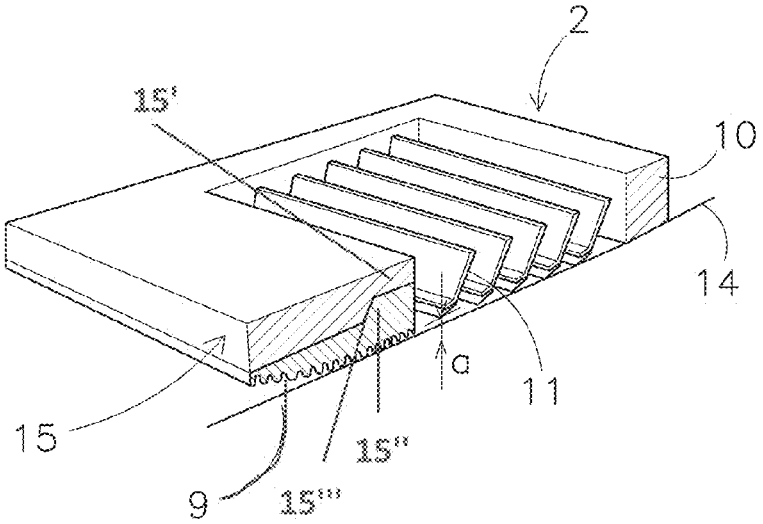
FIG. 2B shows a schematic cross sectional view of a razor blade unit according to the invention as shown in FIG. 2A, but having blades in a working position.

The razor blade unit 2 according to the invention is further elucidated in FIG. 2A and 2B. FIG. 2A shows a rest position of the blades 11. In the rest position, the blade edges of the blades 11 are located at a distance—a—from the exposure plane 14. FIG. 2B shows a working position of the blades 11. In the working position, the front blade 11 is located at a distance—a'—from the exposure plane 14. As shown in FIG. 2, the blade edges may be located at various distances from the exposure plane 14.

The razor blade unit 2 has a blocking mechanism as an adjusting mechanism 15 for moving the blades with respect to the exposure plane 14. The blocking mechanism has a blocking element 151 (see FIG. 2A, 2B), which cooperates with the stretcher 9. The blocking element 151 has a sliding surface and a recess'. The stretcher 9 abuts against the blocking element and is slidably connected to the blocking element. The stretcher 9 has a protrusion 15" which is complementary to the recess of the blocking element. The stretcher 9 is in a first instance movable contrary to a shaving direction. In an initial phase of the shaving process, the stretcher 9 stretches the skin. A drag force caused by the skin causes the stretcher 9 to move in a first movement against a preload generated by a biasing element 15'" of the blocking mechanism. The drag force increases until the preload of the biasing element has been overcome. At that moment, the skin is sufficiently stretched. The blocking element 151 of the blocking mechanism no longer blocks a second movement of the stretcher 9. Thus, the stretcher 9 moves upwards, which redefines the position of the exposure plane 14 with respect to the blades. In other words, the blades 11 are closer to the redefined position of the exposure plane (i.e., the working position) as a result of an upward-moving stretcher 9.

Figure 3:
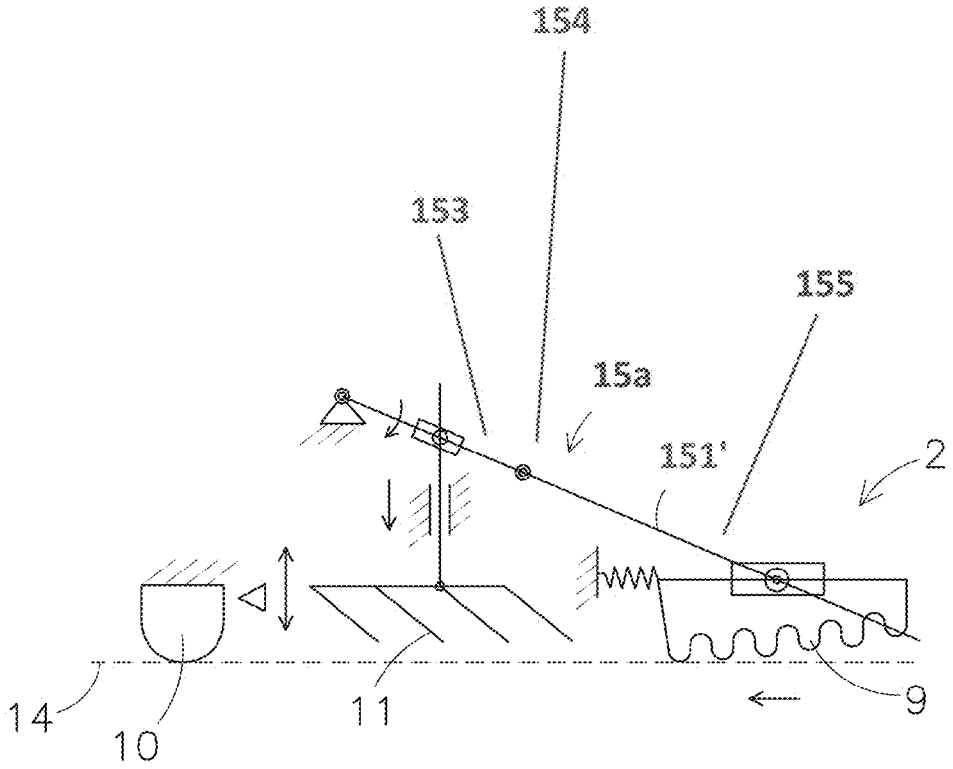
FIG. 3 shows a schematic view of a razor blade unit having a mechanical adjusting mechanism according to the invention.

FIG. 3 shows in a schematic view another embodiment of the razor blade unit according to the invention. The razor blade unit has a mechanically arranged adjusting mechanism 15. A linked bar mechanism is provided to transfer a first movement in the exposure plane 14 to a second movement substantially perpendicularly to the exposure plane 14. The linked bar mechanism is a knee mechanism 151'. The knee mechanism has two bars, a long leg 155 and a short leg 153. The linked bars are of unequal length. The two bars are coupled to each other at the knee 154. A first bar, the short leg, is at one end pivotally connected to a framework of the razor blade unit, while the remaining second bar, the long leg, is at one end pivotally connected to a movable stretcher. Due to a drag force occurring during a shaving operation, the stretcher may move, as a result of which the 'knee' may bend and a blade connected to the short leg may move towards the exposure plane. Further, a biasing element is provided to return the stretcher to its original position. When the stretcher 9 returns, the blade 11 is pulled back into the rest position by the linked bar mechanism.

Figure 4:
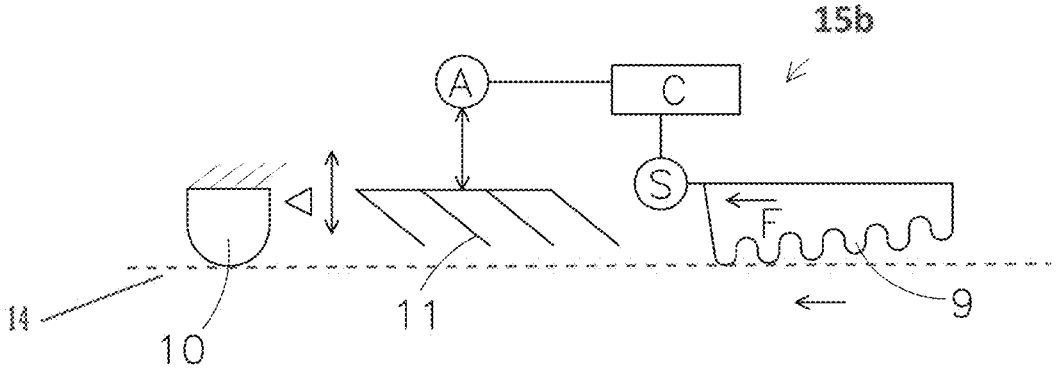
FIG. 4 shows a schematic view of a razor blade unit having an electrical adjusting mechanism according to the invention.

FIG. 4 shows in a schematic view an embodiment of the razor blade unit 1 including an electrical adjusting mechanism 15*b*. The mechanism has an actuator A and a sensor S. The sensor S is mounted close to the stretcher 9. The sensor S is configured to detect a stretch force. The sensor may be a force sensor. A drag force acting on the stretcher 9 may be detected by the sensor S. When a stretch force is detected, a signal is sent from the sensor S to a controller C. The controller C is arranged to control the actuator A. The actuator A is connected to the blade and may move the blade to and fro the exposure plane 14. The shown actuator A is double acting, which means that the actuator acts in two opposite directions. However, it is also possible to use a single-acting actuator A in combination with a biasing element to return the blade to the rest position. A further biasing element may be connected to the stretcher 9 to return the stretcher to an initial position.

In an alternative embodiment, the sensor may be arranged to detect a drag force at the rear support 10.

Figure 5A:
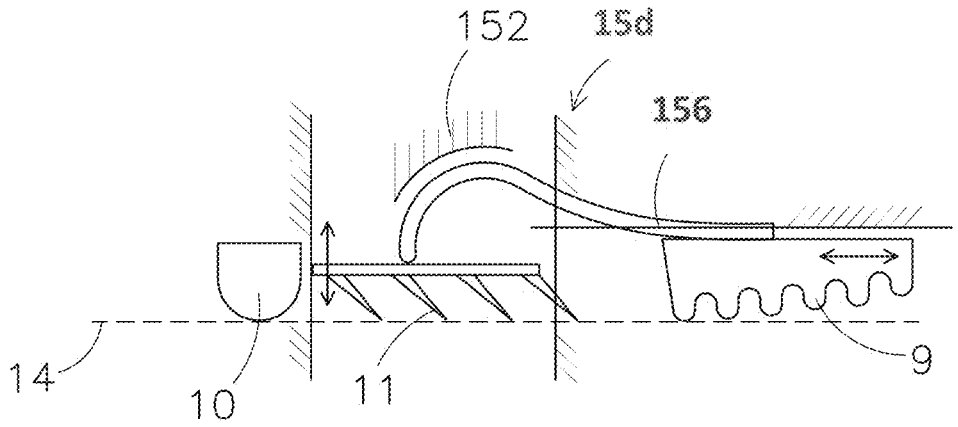
FIG. 5A shows a schematic view of a razor blade unit according to the invention having an adjusting mechanism including a flexible transmission.

FIG. 5A shows an embodiment of the razor blade unit according to the invention including an adjusting mechanism 15d having a flexible transmission member 156. The flexible transmission member is at one end connected to the blade and at the opposite end connected to the stretcher 9. A tip of the flexible transmission member 156 may press the blade 11 towards the exposure plane 14. Several blades 11 are mounted together in a movable blade housing. At a backside, the razor blade unit is provided with a rear support 10, which is fixed to the framework. The stretcher 9 is movably connected to a framework of the razor blade unit. The stretcher 9 may slide in parallel with the exposure plane 14 in the shaving direction as a result of a drag force occurring during shaving. The transmission member is guided by a guiding part 152 of the framework. When the stretcher moves, the transmission member 156 bends and moves the blade at the tip from the rest position to the working position. The tip of the transmission member may be connected to the blade housing. During the movement of the blade at the tip to the working position, spring energy is stored by the flexible transmission member, which may be released during a return movement to the rest position. In this manner, a simple and sustainable configuration is achieved by the shown embodiment.

Figure 5B:
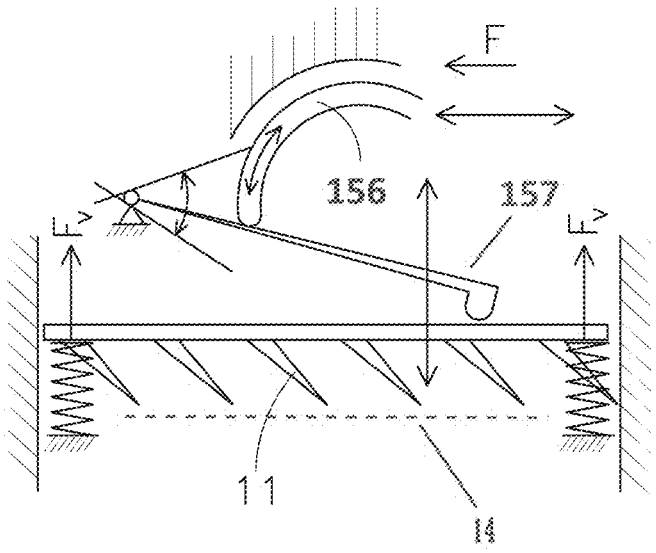
FIG. 5B shows a schematic view of the razor blade unit of FIG. 5A provided with an amplifier element.

FIG. 5B shows in a detailed view focused on the blade housing, a further embodiment of the razor blade unit of FIG. 5A. The blade housing is spring loaded. Springs are connected to the blade housing to return the blade 11 to the rest position. A lever 157 is provided to amplify the force exerted by the transmission member 156. The lever is pivotally connected to the framework of the razor blade unit. The free end of the lever is connected to the blade 11. An angular movement of the lever results in a movement of the blade 11 towards the exposure plane 14. The tip of the transmission member 156 is connected to the lever at the end facing away from the free end. In this manner, a force originating from a drag force on the stretcher and exerted by the transmission member on the lever is amplified and acts on the blade 11.

In comparison with a ploughed skin during the initial phase, the stretched skin is less vulnerable to being cut by a blade edge. Therefore, the operation of the razor blade unit according to the invention having blades in the working position after the skin has been stretched may be safer in use.

Numerous variants are possible in addition to the embodiment shown. Although this invention has been shown and described with respect to detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof The blocking mechanism may for example have another configuration. Therefore, it is intended that the invention will not be limited to the particular embodiments disclosed in the above detailed description, but that the invention will include all embodiments falling within the scope of the appended claims.

Thus, the invention may provide a safer razor blade unit without reducing closeness of blade edges to the skin. By virtue thereof, the shaving results may be optimal and the risk of irritation or cuts may be minimal.

The invention claimed is:

1. A razor blade unit for shaving a skin comprising:

a stretcher having an outer stretch surface for stretching the skin in a shaving direction;

a rear support having an outer support surface which in use contacts the skin to support the razor blade unit;

at least one blade located between the stretcher and the rear support, wherein the blade has a relative position with respect to an exposure plane, said exposure plane being an imaginary plane tangent to the outer stretch surface and to the outer support surface, wherein said relative position is adjustable from a rest position to a working position by means of an adjusting mechanism, wherein in the rest position the skin is less exposed to the blade than in the working position;

wherein the adjusting mechanism is actuatable by a drag force exerted by the skin on the stretcher during a sliding movement of the razor blade unit over the skin in a shaving direction of the razor blade unit and wherein the stretcher is movable a first movement relative to the blade in the shaving direction an in a second movement substantially perpendicular with respect to the exposure plane.

2. The razor blade unit according to claim 1, wherein the adjusting mechanism includes a blocking element, including a biasing element, blocking the blade in the rest position.

3. The razor blade unit according to claim 2, wherein the stretcher is in sliding contact with the blocking element.

4. The razor blade unit according to claim 2, wherein the blocking element has a recess and, wherein the stretcher has a complementary protrusion which cooperates with the recess.

5. The razor blade unit according to claim 2, wherein the biasing element and the blocking element are in a single piece.

6. The razor blade unit according to claim 1, wherein a total distance of movement of the exposure plane from the rest position to the working position is adjustable.

7. The razor blade unit according to claim 1, wherein the front blade has a blade edge which in the working position is located at a perpendicular distance of at most 150 μm from the exposure plane.

8. The razor blade unit according to claim 1, wherein the exposure plane is movable by a movement of the rear support.

9. The razor blade unit according to claim 1, wherein the exposure plane is movable by both a movement of the rear support and the stretcher.

10. The razor blade unit according to claim 1, wherein the adjusting mechanism comprises;

an actuator; and a sensor, wherein the actuator is configured to move the blade with respect to the exposure plane and wherein the sensor is configured to activate the actuator in dependence on a detected drag force.

11. The razor blade unit according to claim 1, wherein the adjusting mechanism comprises;

a transmission member for transferring a movement of the stretcher or rear support substantially in parallel with the exposure plane into a substantially perpendicular movement of the blade towards the exposure plane.

12. The razor blade unit according to claim 11, wherein the adjusting mechanism comprises;

a knee mechanism formed out of linked bars as the transmission member.

13. Shaving device comprising a working head which is connected to a base portion, wherein the working head comprises a razor blade unit comprising:

a stretcher having an outer stretch surface for stretching skin in a shaving direction;

a rear support having an outer support surface which in use contacts the skin to support the razor blade unit;

at least one blade located between the stretcher and the rear support, wherein the blade has a relative position with respect to an exposure plane, said exposure plane being an imaginary plane tangent to the outer stretch surface and to the outer support surface, wherein said relative position is adjustable from a rest position to a working position by means of an adjusting mechanism, wherein the rest position the skin is less exposed to the blade than when in the working position;

wherein the adjusting mechanism is actuatable by a drag force exerted by the skin on the stretcher during a sliding movement of the razor blade unit over the skin in a shaving direction of the razor blade unit and wherein the stretcher is movable in a first movement relative to the blade in the shaving direction and in a second movement substantially perpendicularly with respect to the exposure plane.

* * * * *